United States Patent [19]

Mandusky et al.

[11] 4,004,303

[45] Jan. 25, 1977

[54] SPRING ASSEMBLY AND BOXSPRING UNIT INCORPORATING SAME

[75] Inventors: Jack C. Mandusky; Neville L. Riddle, both of Lexington, Ky.

[73] Assignee: Hoover Ball and Bearing Company, Saline, Mich.

[22] Filed: July 21, 1975

[21] Appl. No.: 597,411

[52] U.S. Cl. ..... 5/247; 5/186 R

[51] Int. Cl.[2] ..... A47C 23/02

[58] Field of Search ..... 5/189, 186 R, 246, 247, 5/186; 267/110, 111, 112, 80

[56] References Cited

UNITED STATES PATENTS

| | | | |
|---|---|---|---|
| 844,681 | 2/1907 | Laughlin | 5/186 R X |
| 1,135,797 | 4/1915 | Hirsch | 5/189 |
| 1,741,022 | 12/1929 | Hosner | 5/189 X |
| 3,526,910 | 9/1970 | Ikeda | 5/186 R |
| 3,913,154 | 10/1975 | Sweeney | 5/186 R |

*Primary Examiner*—Paul R. Gilliam
*Assistant Examiner*—Andrew M. Calvert
*Attorney, Agent, or Firm*—Olsen and Stephenson

[57] ABSTRACT

A spring assembly for use with a generally rectangular frame comprising a plurality of individual wire spring members interconnected to form a horizontal yieldable support deck, each spring member having a plurality of substantially square side-by-side U-shaped sections comprising a base portion and generally parallel leg portions which terminate in transversely extending leg extensions, one leg extension being integrally connected to a leg extension of the adjacent U-shaped section on one side thereof, and the other leg extension being connected to a leg extension of the adjacent U-shaped section on the other side thereof. The spring members are interconnected so that the junctures of the base portion and the leg portions of each U-shaped section of one spring member interconnects with an aligned U-shaped section of an adjacent spring member at the junctures of the leg portions and leg extensions thereof to thereby provide for pivotal movement of each spring member relative to the adjacent spring member. A box spring unit is economically and simply constructed by mounting the spring assembly on a wood frame and providing a layer of foam material on the spring assembly.

2 Claims, 4 Drawing Figures

FIG. 2
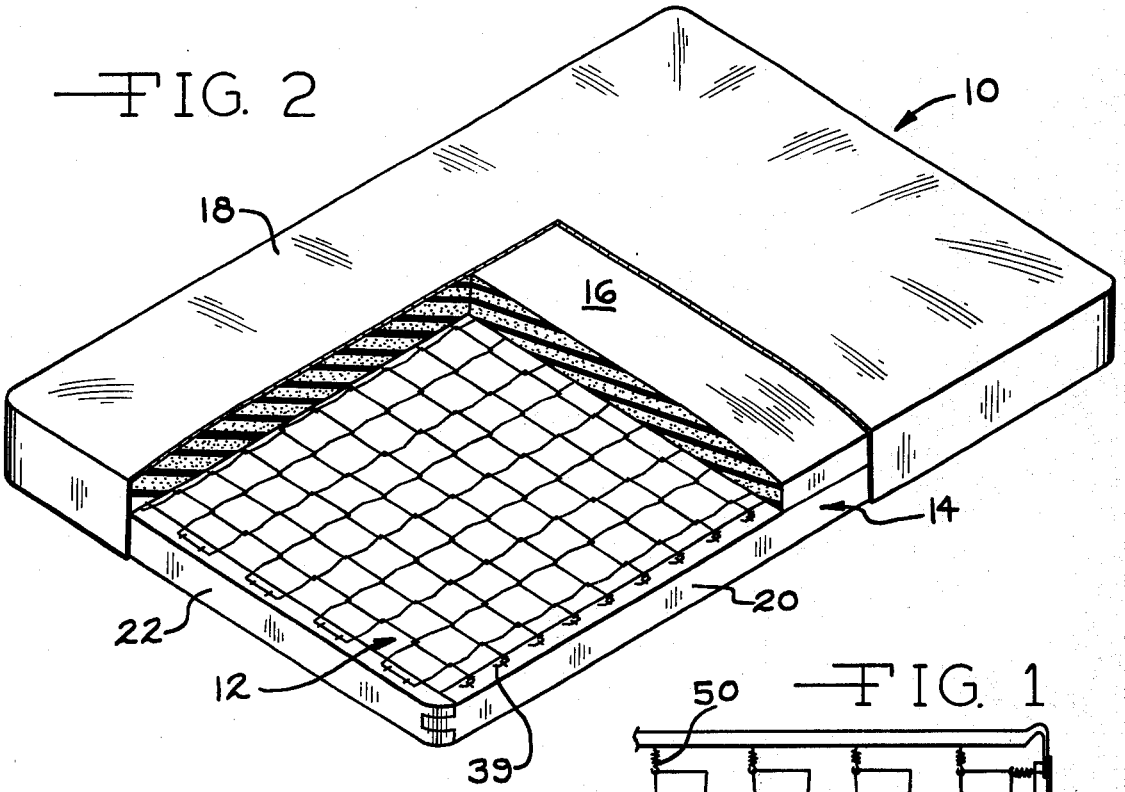
FIG. 1
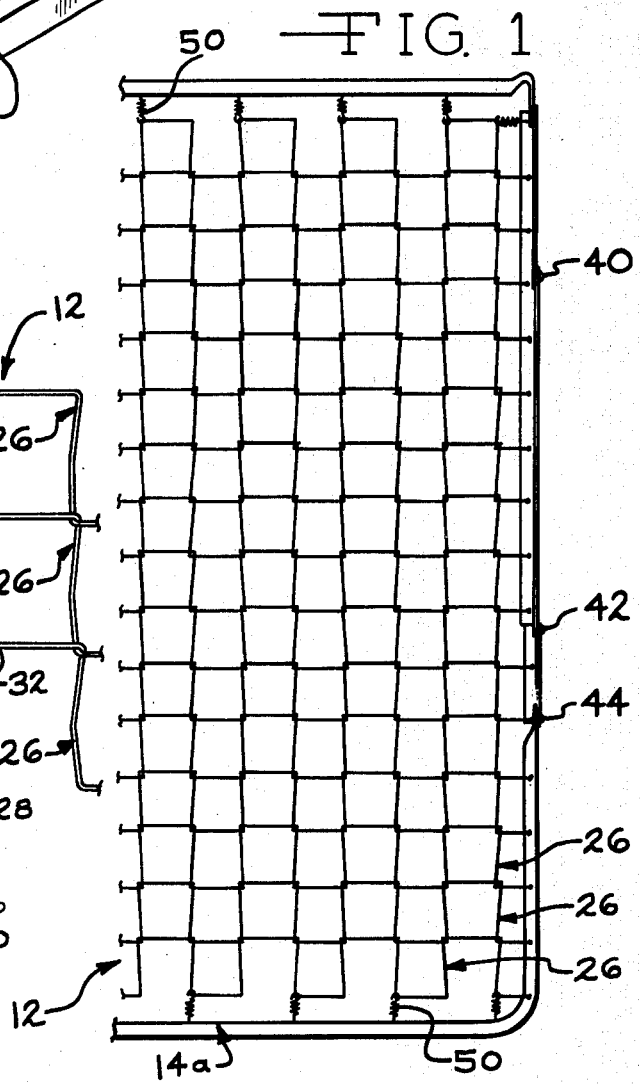
FIG. 3
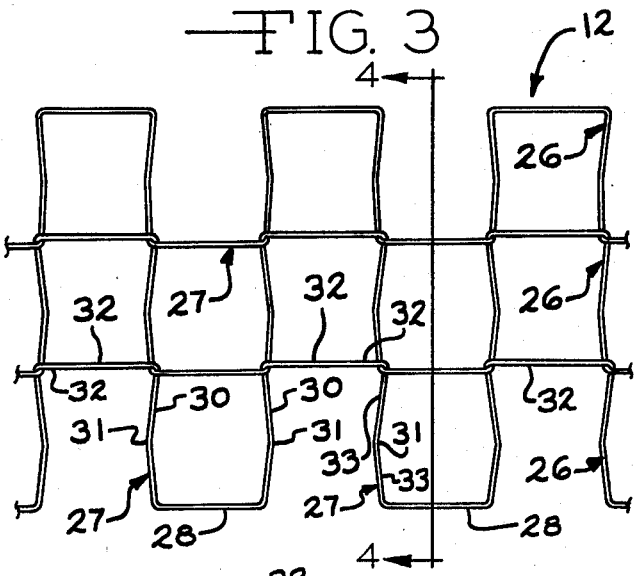
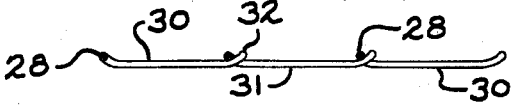
FIG. 4

SPRING ASSEMBLY AND BOXSPRING UNIT INCORPORATING SAME

BACKGROUND OF THE INVENTION

The present invention provides a spring assembly that is not limited to any particular use but which is particularly useful in a box spring unit or a sofa bed. Conventional box springs have spring assemblies which comprise numerous spring members that occupy substantial vertical space within the box spring in order to provide the desired support. As a result, these box springs are heavy and costly to manufacture.

Sofa beds which are currently in use have spring assemblies which tend to be large, cumbersome and heavy, since additional linkage members connecting the springs are required to provide for adequate folding action of the spring assembly and, thus, are expensive to manufacture. In addition, springs which require additional linkage elements to connect the spring assembly may come apart thus creating troublesome repair problems. There is a need, therefore, in the bedding industry and perhaps in the seating industry for a spring assembly which is simple, light in weight, easily foldable and can be manufactured at low cost.

It is, thus, the object of this invention to provide a spring assembly formed of a plurality of interconnected flat wire springs that are easy to assemble so as to form a spring fabric that can readily be applied to any rectangular frame and is foldable upon itself to adapt it to environments in which folding is desired. It is also an object to provide a box spring unit utilizing the spring assembly of this invention.

SUMMARY OF THE INVENTION

A spring assembly is provided which consists of a plurality of individual spring members that are interconnected to form a yieldable horizontal support deck. Each of the spring members consists of a single wire rod bent to form a plurality of side-by-side U-shaped sections that are substantially square in shape. Each U-shaped section has a base portion, and parallel leg portions extending therefrom. Each leg portion terminates in a transverse leg extension which is integrally connected to the leg extension of an adjacent U-shaped section. In the present embodiment, the leg portions of each U-shaped section are bent outwardly of each other, intermediate their ends, to facilitate the assembly of the spring members and enhance the yieldability of the spring assembly. When assembled, the junctures of the base portion and the leg portions of each U-shaped member overlap and are interconnected to the junctures of the leg extensions and the leg portions of the U-shaped sections of an adjacent spring member so that each spring member is pivotal relative to each adjacent spring member.

The present invention thus provides a generally flat spring fabric consisting of a plurality of individual flat spring members that are assembled and interconnected so that adjacent spring members are foldable and pivotable relative to each other. It has been discovered that conveyor belts for the candy industry have been manufactured with links that have a configuration similar to the configuration of the springs in the present invention. A conveyor belt of this type is shown in U.S. Patent 2,826,383. However, the belt links shown therein are not spring members and are in fact intended to be relatively inelastic.

Further objects, features and advantages of the present invention will become apparent from a consideration of the following description, the appended claims and the accompanying drawing in which:

FIG. 1 is a fragmentary top view of the spring assembly of the present invention attached to the frame of a foldable sofa bed;

FIG. 2 is a perspective view of a box spring constructed according to this invention with a corner thereof broken away to show the spring assembly of this invention therein;

FIG. 3 is a fragmentary top view of a portion of the spring assembly; and

FIG. 4 is a side sectional view of the spring assembly taken substantially from the line 4—4 in FIG. 3.

With reference to the drawing, the box spring of this invention, indicated generally at 10, is shown in FIG. 2 as including the spring assembly 12 of this that and a frame 14 on which the spring assembly 12 is mounted. The rectangular frame 14 includes a pair of side rails 20, only one of which is shown, and a pair of end rails 22, only one of which is shown. A cushion 16, consisting of foam material, is supported on the spring assembly 12 and frame 14 and is retained thereon by a conventional overlying cover 18 secured in a well known manner to the frame 14.

As best seen in FIG. 3, the spring assembly 12 comprises a plurality of individual flat spring members 26 which are interconnected to form a flat spring fabric is mounted on the frame 14 so as to form a generally horizontal spring deck on which the cushion 16 is supported. Each spring member 26 consists of a single wire rod bent to form a plurality of substantially square side-by-side U-shaped sections 27. Each section 27 has a base portion 28 and generally parallel leg portions 30. The leg portions 30 terminate in transversely extending leg extensions 32 each of which is formed integral with a leg extension 32 of an adjacent U-shaped section 27.

As shown in FIG. 3, the leg portions 30 of each U-shaped section 27 are bowed or outwardly bent intermediate of their ends. In the present embodiment, each leg portion 30 is of an open V-shape having a pair of diverging arms 33 which meet at an apex 31. When assembled, the U-shaped sections 27 of each spring member 26 are interconnected so that the junctures between the base portion 28 and the leg portions 30 thereof overlap and are interconnected to the junctures between the leg portions 30 and the leg extensions 32 on an adjacent spring member 26.

As shown in FIG. 4, the base portions 28 and the leg extensions 32 are upwardly bent from the leg portions 30. This allows the spring assembly 12 to lie substantially flat and also provides for easy pivotal movement of each spring member 26 relative to an adjacent spring member 26.

The spring assembly 12 is attached to the frame 14 of the box spring 10 with any suitable fasteners such as staples 39. As can be seen in FIG. 2, the spring assembly 12 functions as a horizontal yieldable support deck that occupies little vertical space in a conventional box spring 10. The space below the spring assembly 12 can now be used for storage purposes. Sliding drawers (not shown) can be conveniently incorporated in the frame 14 for this purpose.

FIG. 1 shows the spring assembly 12 attached to a portion of the frame **14*a* in a conventional sofa bed. The frame 14*a* has relatively foldable sections, as is conventional in such frames, so the spring assembly 12** must also fold upon itself. The frame 14*a* is hinged at 40, 42 and 44 to allow the frame 14*a* to be folded to thus provide for internal storage of the bed portion in the sofa bed. Each spring member 26 is secured to the side rails 46 (one shown) of the frame 14*a*, and the end spring members 26 of the assembly 12 are attached to the end rails 48 by coil springs 50 which increase the yieldability of the spring assembly 12.

In operation, the spring members 26 are interconnected to each other by inserting the U-shaped sections 27 of one spring member 26 into the U-shaped sections 27 of an adjacent spring member 26 to form the completed spring assembly 12. More specifically, with one spring member 26 in a flat position, another spring member 26 in an upright position is moved downwardly toward the first spring member 26 so that the base portions 28 of each of the sections 27 in the downwardly moving spring member are inserted between the legs 30 in the aligned sections 27 of the flat spring. The outward bowing of the legs 30 in the flat spring 26 facilitates this assembly. The inserted spring member 26 is then pulled through the flat spring 26 with the bowed legs 30 in the inserted spring moving toward each other to accommodate this movement. The inserted spring 26 is then rotated into the plane of the flat spring member 26 so that the leg portions 30 of the U-shaped sections 27 of the inserted spring 26 interconnect with the base portions 28 in the U-shaped sections 27 of the flat spring member 26. The above described steps are repeated for additional springs 26 until a spring fabric of the desired size has been formed.

From the above description, it is seen that a spring assembly 12 is provided consisting of a plurality of flat spring members 26 formed to a plurality of U-shaped sections 27 which, when interconnected with other springs 26, form a spring assembly 12 that is readily foldable and can be adapted to replace present spring assemblies in conventional box springs or which can be used as the spring support in conventional sofa beds. Each spring member 26 can pivot relative to an adjacent spring member 26 without the use of additional linkage members. Each U-shaped section of the spring 26 has a base portion 28 and parallel leg portions 30 which in the present invention are bent outwardly of each other to thereby improve yieldability and facilitate in the assembly of similar spring members 26. The sections 27 are substantially square, by which is meant the legs 30 are about the same length as the base 28. This configuration provides the necessary yieldability in the assembly 12 as well as providing the assembly 12 with adequate support capability when it functions as a spring deck.

What is claimed:

1. For use with a generally rectangular frame, a spring assembly comprising a plurality of individual wire spring members interconnected to form a horizontal yieldable support deck, each spring member having a plurality of side-by-side U-shaped sections, each of said U-shaped sections comprising a base portion and generally parallel leg portions terminating in transversely extending leg extensions, one of said leg extensions being integral with the leg extension of an adjacent U-shaped section on one side thereof and the other of said leg extensions being integral with the adjacent U-shaped section on the other side thereof, said spring members being interconnected so that the junctures of the base portion and the leg portions of each U-shaped section interconnect with an adjacent spring member at the junctures of the leg portions and the leg extensions of the U-shaped section to thereby enable pivotal movement of said spring members relative to each other, the leg portions of each U-shaped section being outwardly bent away from each other intermediate their ends to facilitate assembly of adjacent spring members by moving the base portions on one spring member through the spaces between the leg portions which are outwardly bent away from each other in the other spring member.

2. A spring assembly according to claim 1 wherein each of said outwardly bent leg portions is of an open V-shape having a pair of diverging arms which meet at an apex located intermediate the ends of said leg portion.

* * * * *